US012270413B2

(12) United States Patent
Iwakiri et al.

(10) Patent No.: US 12,270,413 B2
(45) Date of Patent: Apr. 8, 2025

(54) COMPRESSOR HOUSING AND CENTRIFUGAL COMPRESSOR

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Tadashi Kanzaka, Tokyo (JP); Yutaka Fujita, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 18/018,144

(22) PCT Filed: Sep. 7, 2020

(86) PCT No.: PCT/JP2020/033798
§ 371 (c)(1),
(2) Date: Jan. 26, 2023

(87) PCT Pub. No.: WO2022/049773
PCT Pub. Date: Mar. 10, 2022

(65) Prior Publication Data

US 2023/0272805 A1 Aug. 31, 2023

(51) Int. Cl.
*F04D 29/42* (2006.01)
*F04D 17/10* (2006.01)
*F04D 29/44* (2006.01)

(52) U.S. Cl.
CPC ..... *F04D 29/441* (2013.01); *F04D 17/10* (2013.01); *F04D 29/4206* (2013.01)

(58) Field of Classification Search
CPC .... F04D 29/441; F04D 29/4206; F04D 17/10; F04D 29/685
See application file for complete search history.

(56) References Cited

U.S. PATENT DOCUMENTS 10,125,793 B2 * 11/2018 Tomita ..... F04D 29/4213
2015/0337863 A1 11/2015 Tomita et al.
(Continued)

FOREIGN PATENT DOCUMENTS

CN 105264236 A 1/2016
JP 2008-175124 A 7/2008
(Continued)

OTHER PUBLICATIONS

International Preliminary Report on Patentability and Written Opinion of the International Searching Authority for International Application No. PCT/JP2020/033798, dated Mar. 16, 2023, with an English translation.
(Continued)

*Primary Examiner* — Sabbir Hasan
(74) *Attorney, Agent, or Firm* — Birch, Stewart, Kolasch & Birch, LLP

(57) ABSTRACT

A compressor includes: a shroud surface; a front-side inner peripheral surface formed on a front side of the shroud surface in the axial direction and disposed outward of a front end of the shroud surface in the radial direction; and at least one projection protruding from the front-side inner peripheral surface inward in the radial direction. A rear end of the at least one projection is configured to be connected to the front end of the shroud surface. The at least one projection is formed in a plate shape, and in a cross-sectional view along an axis of the impeller, has an inclined front edge extending obliquely to the axis of the impeller from a front end of the projection toward a rear side.

9 Claims, 11 Drawing Sheets

(56) References Cited

U.S. PATENT DOCUMENTS

| | | | | |
|---|---|---|---|---|
| 2016/0084263 | A1 | 3/2016 | Morita | |
| 2018/0163731 | A1* | 6/2018 | Matsuda | F04D 29/444 |

FOREIGN PATENT DOCUMENTS

| | | | |
|---|---|---|---|
| JP | 2008-208753 | A | 9/2008 |
| JP | 5720267 | B2 | 5/2015 |
| JP | 2017-44164 | A | 3/2017 |
| JP | 2017-210902 | A | 11/2017 |
| JP | 6263997 | B2 | 1/2018 |
| JP | 6279524 | B2 | 2/2018 |
| JP | 2018-96302 | A | 6/2018 |
| WO | WO 2014/128939 | A1 | 8/2014 |

OTHER PUBLICATIONS

International Search Report and Written Opinion of the International Searching Authority for International Application No. PCT/JP2020/033798, dated Nov. 10, 2020.
Office Action issued in Chinese Application No. 202080104695.1 on Dec. 31, 2024.

* cited by examiner

COMPRESSOR HOUSING AND CENTRIFUGAL COMPRESSOR

TECHNICAL FIELD

The present disclosure relates to a compressor housing for rotatably accommodating an impeller of a centrifugal compressor and a centrifugal compressor including the compressor housing.

BACKGROUND

A centrifugal compressor used in a compressor part or the like of a turbocharger for an automobile or a ship imparts kinetic energy to a fluid (e.g., air) through rotation of an impeller and discharges the fluid outward in the radial direction, thereby achieving a pressure increase of the fluid by utilizing the centrifugal force. Such a centrifugal compressor is provided with various features to meet the need to improve the pressure ratio and the efficiency in a broad operational range.

For example, at a low flow rate when the intake flow rate of the centrifugal compressor is low, an instability phenomenon called surging may occur in which the fluid vibrates violently in a fluid flow direction. If surging occurs, a reverse flow, which flows in a reverse direction from the flow of air introduced through the intake port, occurs in the vicinity of the shroud surface, which may lead to a decrease in efficiency of the centrifugal compressor.

CITATION LIST

Patent Literature

Patent Document 1: JP6279524B

SUMMARY

Problems to be Solved

Patent Document 1 discloses that the reverse flow is suppressed by guiding the reverse flow inward in the radial direction with a plate-shaped protruding portion to pressurize the air flowing to the impeller.

In order to improve the efficiency of the centrifugal compressor, it is necessary to suppress pressure loss of a working fluid flowing through the compressor housing as much as possible.

In view of the above, an object of at least one embodiment of the present disclosure is to provide a compressor housing that can improve the efficiency of a centrifugal compressor, and a centrifugal compressor including the compressor housing.

Solution to the Problems

A compressor housing according to the present disclosure is a compressor housing for rotatably accommodating an impeller of a centrifugal compressor, including: a shroud surface including a surface facing a tip of an impeller blade of the impeller with a predetermined gap; a front-side inner peripheral surface formed on a front side of the shroud surface in an axial direction and disposed outward of a front end of the shroud surface in a radial direction; and at least one projection protruding from the front-side inner peripheral surface inward in the radial direction. A rear end of the at least one projection is configured to be connected to the front end of the shroud surface. The at least one projection is formed in a plate shape, and in a cross-sectional view along an axis of the impeller, has an inclined front edge extending obliquely to the axis of the impeller from a front end of the projection toward a rear side.

A centrifugal compressor according to the present disclosure includes the above-described compressor housing.

Advantageous Effects

At least one embodiment of the present disclosure provides a compressor housing that can improve the efficiency of a centrifugal compressor, and a centrifugal compressor including the compressor housing.

DETAILED DESCRIPTION

Figure 1:
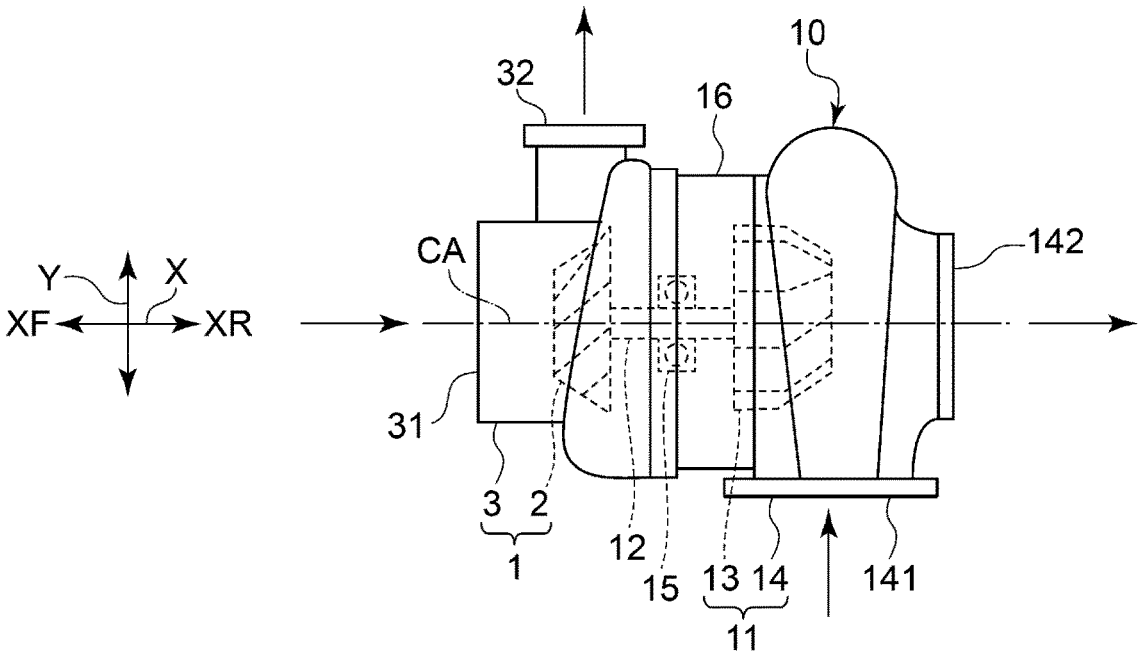
FIG. 1 is an explanatory view for describing the configuration of a turbocharger including a centrifugal compressor according to an embodiment.

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

The same features can be indicated by the same reference numerals and not described in detail.

Centrifugal Compressor and Turbocharger

Figure 2:
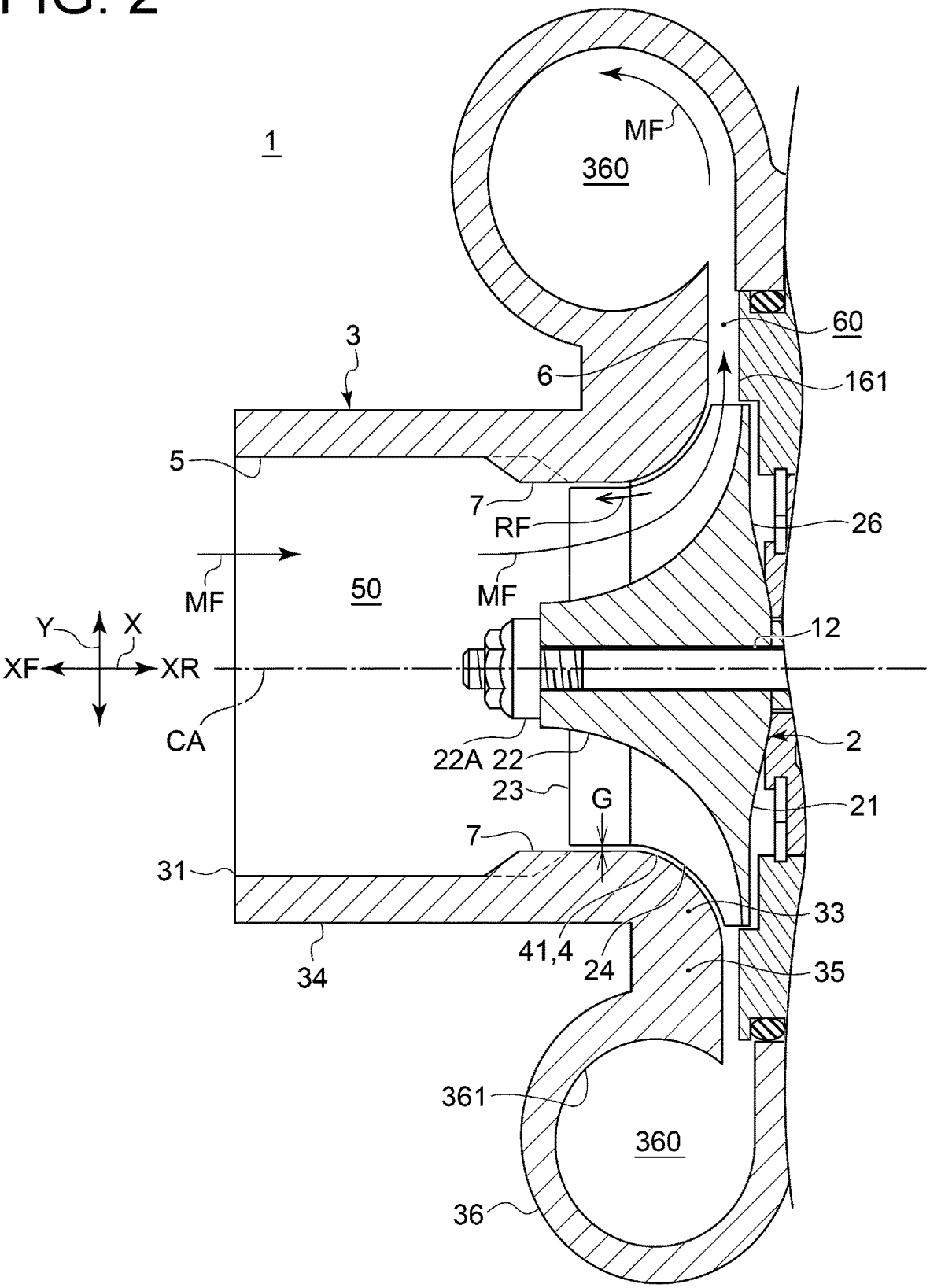
FIG. 2 is a schematic cross-sectional view schematically showing a compressor side of the turbocharger including the centrifugal compressor according to an embodiment, the schematic cross-sectional view including the axis of the centrifugal compressor.

FIG. 1 is an explanatory diagram for describing the configuration of a turbocharger equipped with a centrifugal compressor according to an embodiment. FIG. 2 is a schematic cross-sectional view schematically showing a compressor side of the turbocharger including the centrifugal compressor according to an embodiment, the schematic cross-sectional view including the axis of the centrifugal compressor.

As shown in FIGS. 1 and 2, a centrifugal compressor 1 according to some embodiments of the present disclosure includes an impeller 2 and a compressor housing 3 for rotatably accommodating the impeller 2.

The centrifugal compressor 1 can be applied to, for example, turbochargers 10 for automobiles, ships, or power generation, or other industrial centrifugal compressors, blowers, or the like. In the illustrated embodiment, the centrifugal compressor 1 is mounted on the turbocharger 10. As shown in FIG. 1, the turbocharger 10 includes the centrifugal compressor 1, a turbine 11, and a rotational shaft 12. The turbine 11 includes a turbine rotor 13 mechanically coupled to the impeller 2 via the rotational shaft 12 and a turbine housing 14 for rotatably accommodating the turbine rotor 13.

In the illustrated embodiment, as shown in FIG. 1, the turbocharger 10 further includes a bearing 15 rotatably supporting the rotational shaft 12 and a bearing housing 16 configured to accommodate the bearing 15. The bearing housing 16 is disposed between the compressor housing 3 and the turbine housing 14, and is mechanically coupled to the compressor housing 3 and the turbine housing 14 by fastening members (e.g., fastening bolts).

Hereinafter, for example as shown in FIG. 1, the extension direction of the axis CA of the centrifugal compressor 1, i.e., the axis of the impeller 2 is defined as the axial direction X, and the direction perpendicular to the axis CA is defined as the radial direction Y. In the axial direction X, the upstream side with respect to the intake direction of the centrifugal compressor 1 (the introduction direction of main flow to the impeller 2), i.e., the side where an intake port 31 is located with respect to the impeller 2 (the left side in the figure) is defined as the front side XF. Further, in the axial direction, the side opposite to the front side XF, i.e., the downstream side with respect to the intake direction of the centrifugal compressor 1 (the right side in the figure) is defined as the rear side XR.

In the embodiment shown in FIG. 1, the compressor housing 3 has an intake port 31 for introducing a fluid (e.g., air) from the outside to the inside of the compressor housing 3, and a discharge port 32 for discharging the fluid having passed through the impeller 2 to the outside of the compressor housing 3. The turbine housing 14 has a turbine-side introduction port 141 for introducing a working fluid (e.g., exhaust gas) for rotating the turbine rotor 13 from the outside to the inside of the turbine housing 14, and a turbine-side discharge port 142 for discharging the working fluid having passed through the turbine rotor 13 to the outside of the turbine housing 14.

As shown in FIG. 1, the rotational shaft 12 has a longitudinal direction along the axial direction X. The rotational shaft 12 is mechanically coupled to the impeller 2 on one side (front side XF) in the longitudinal direction of the rotational shaft 12, and is mechanically coupled to the turbine rotor 13 on another side (rear side XR) in the longitudinal direction of the rotational shaft 12.

The turbocharger 10 rotates the turbine rotor 13 by the working fluid introduced into the turbine housing 14 through the turbine-side introduction port 141. Examples of the working fluid include exhaust gas generated from an exhaust gas production device (e.g., internal combustion engine such as engine) (not shown). Since the impeller 2 is mechanically connected to the turbine rotor 13 via the rotational shaft 12, the impeller 2 rotates in conjunction with the rotation of the turbine rotor 13. Rotating the impeller 2, the turbocharger 10 compresses the fluid introduced into the compressor housing 3 through the intake port 31 and sends the compressed fluid to a supply destination (e.g., internal combustion engine such as engine) through the discharge port 32.

(Impeller)

As shown in FIG. 2, the impeller 2 includes a hub 21 and a plurality of impeller blades 23 disposed on an outer surface 22 of the hub 21. Since the hub 21 is mechanically fixed to one side of the rotational shaft 12, the hub 21 and the plurality of impeller blades 23 can rotate in conjunction with the rotational shaft 12 about the axis CA of the impeller 2. The impeller 2 is accommodated in the compressor housing 3 and is configured to guide the fluid introduced from the front side XF in the axial direction X to the outer side in the radial direction Y.

In the illustrated embodiment, the outer surface 22 of the hub 21 is formed into a concavely curved shape in which the distance from the axis CA of the impeller 2 increases from the front side XF toward the rear side XR. The plurality of impeller blades 23 are spaced apart from each other in the circumferential direction around the axis CA. A shroud surface 4 includes a surface 41 formed into a convexly curved shape in which the distance from the axis CA of the impeller 2 increases from the front side XF toward the rear side XR. The tip (tip-side end) 24 of each impeller blade 23 is located opposite to the connection (hub-side end) between the hub 21 and the outer surface 22. A gap G (clearance) is formed between the tip 24 and the surface 41 curved convexly so as to face the tip 24.

(Compressor Housing)

In the illustrated embodiment, as shown in FIG. 2, the compressor housing 3 includes a shroud portion 33 having the shroud surface 4 described above, an intake air introduction portion 34 forming an intake air introduction path 50 of the centrifugal compressor 1, a diffuser portion 35 forming a diffuser passage 60 of the centrifugal compressor 1, and a scroll portion 36 forming a scroll passage 360 of the centrifugal compressor 1.

The intake air introduction path 50 is a flow passage for guiding the intake air (e.g., fluid such as air) introduced through the intake port 31 of the compressor housing 3 toward the impeller blades 23. The diffuser passage 60 is a flow passage for guiding the fluid having passed through the impeller 2 to the spiral scroll passage 360 disposed around the impeller 2. The scroll passage 360 is a flow passage for guiding the fluid having passed through the impeller 2 and the diffuser passage 60 to the outside of the compressor housing 3 through the discharge port 32 (see FIG. 1).

The intake air introduction path 50 and the scroll passage 360 are formed in the compressor housing 3. The intake air introduction portion 34 has a front-side inner peripheral surface 5 forming the intake air introduction path 50. The front-side inner peripheral surface 5 is formed on the front side XF of the shroud surface 4 in the axial direction and disposed outward of a front end 42 (front side XF end) of the shroud surface 4 in the radial direction Y. The intake port 31 is formed at the front end of the intake air introduction portion 34.

The scroll passage 360 is located outward of the impeller 2 in the radial direction Y so as to surround the periphery of the impeller 2 accommodated in the compressor housing 3. The scroll portion 36 has a passage wall surface 361 forming the scroll passage 360.

Further, in the illustrated embodiment, as shown in FIG. 2, the compressor housing 3 is combined with another member (the bearing housing 16 in the illustrated example) to form the diffuser passage 60. The diffuser passage 60 is formed by a diffuser surface 6 and a surface 161 of the bearing housing 16 facing the diffuser surface 6. Alternatively, in some embodiments, the compressor housing 3 may internally form the diffuser passage 60.

The shroud portion 33 is disposed between the intake air introduction portion 34 and the diffuser portion 35. The outlet of the intake air introduction path 50 communicates with the inlet of the diffuser passage 60, and the outlet of the diffuser passage 60 communicates with the inlet of the scroll passage 360. The fluid introduced into the compressor housing 3 through the intake port 31 flows through the intake air introduction path 50 toward the rear side XR, and then is sent to the impeller 2. The fluid sent to the impeller 2 flows through the diffuser passage 60 and the scroll passage 360 in this order, and then is discharged to the outside of the compressor housing 3 from the discharge port 32 (see FIG. 1).

At a low flow rate when the intake flow rate of the centrifugal compressor 1 (the flow rate of main flow MF flowing into the intake air introduction path 50 through the intake port 31 and flowing to the impeller 2) is low, an instability phenomenon called surging may occur in which the fluid vibrates violently in a fluid flow direction. If surging occurs, a reverse flow, which flows in a reverse direction from the main flow MF, that is, toward the front side XF in the axial direction X, occurs in the vicinity of the shroud surface 4, which may lead to a decrease in efficiency of the centrifugal compressor 1.

Figure 3:
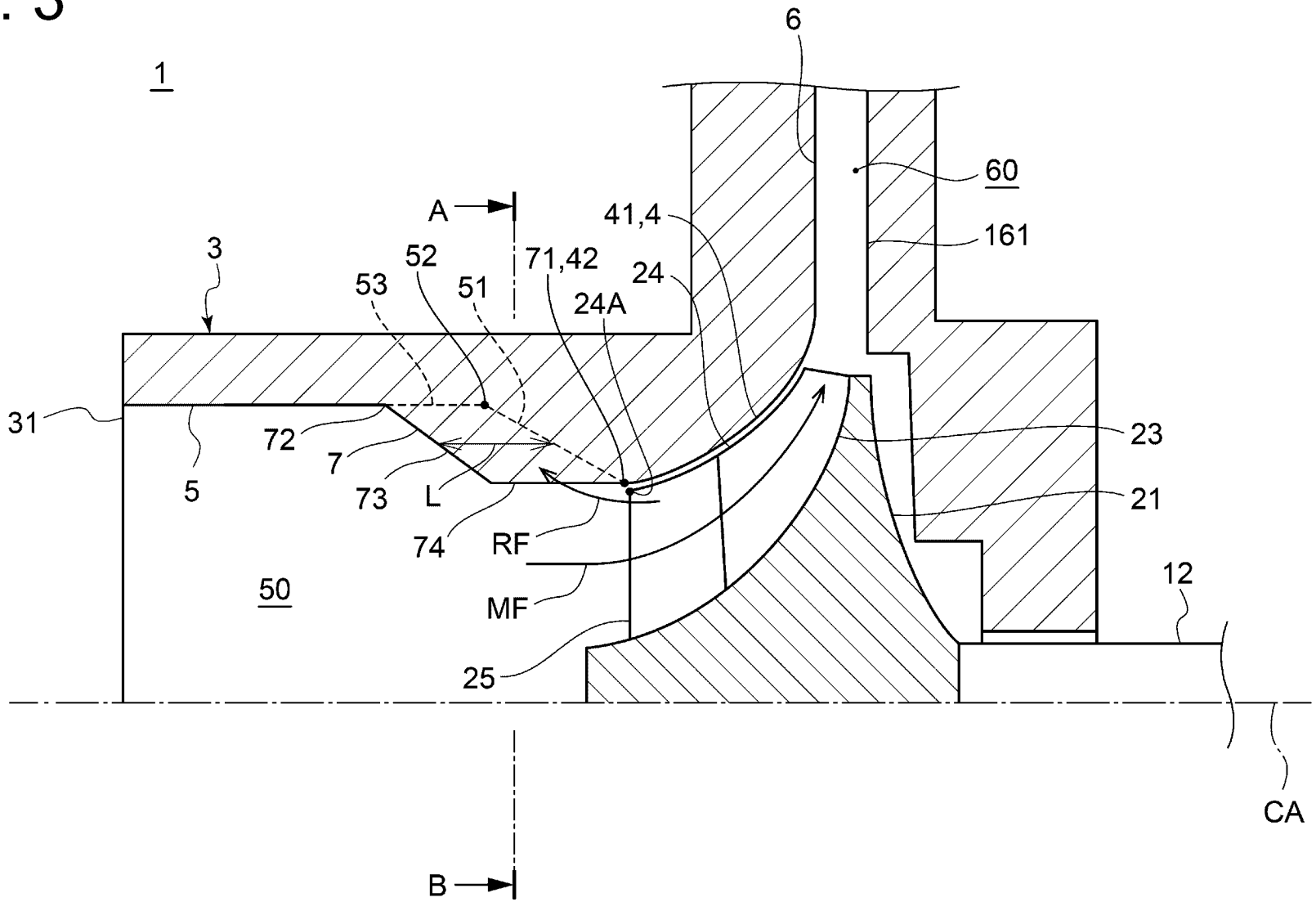
FIG. 3 is an explanatory view for describing a compressor housing according to the first embodiment.
Figure 4:
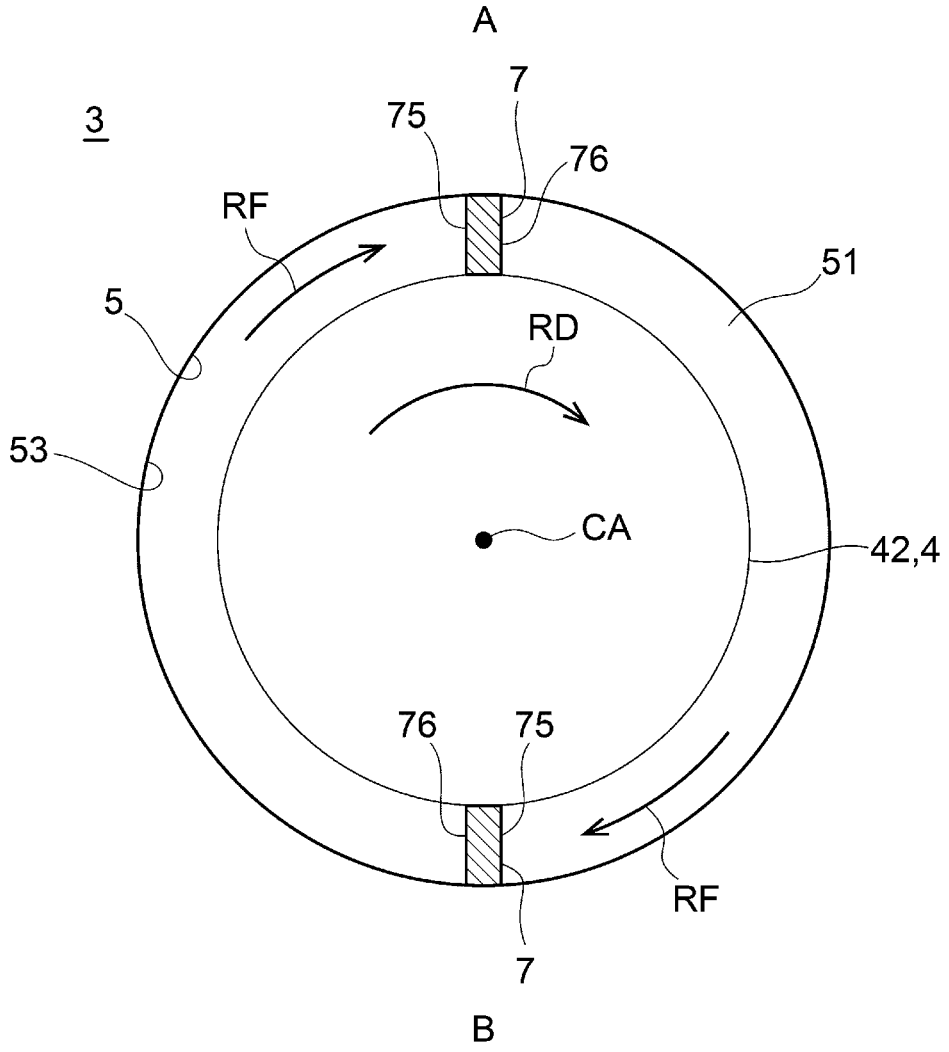
FIG. 4 is a schematic cross-sectional view schematically showing cross-section A-B in FIG. 3.

FIG. 3 is an explanatory view for describing a compressor housing according to the first embodiment. FIG. 4 is a schematic cross-sectional view schematically showing cross-section A-B in FIG. 3.

As shown in FIG. 3, the compressor housing 3 according to some embodiments includes the shroud surface 4 including the surface 41 facing the tip 24 of the impeller blade 23 of the impeller 2 with a predetermined gap G, the front-side inner peripheral surface 5 formed on the front side XF of the shroud surface 4 in the axial direction and disposed outward of the front end 42 of the shroud surface 4 in the radial direction Y, and at least one projection 7 protruding from the front-side inner peripheral surface 5 inward in the radial direction Y.

A rear end 71 (rear side XR end) of the projection 7 is connected to the front end 42 of the shroud surface 4. In a cross-sectional view along the axis CA of the impeller 2, as shown in FIG. 3, the projection 7 has an inclined front edge 73 extending obliquely to the axis CA of the impeller 2 from a front end 72 of the projection 7 toward the rear side XR.

The projection 7 is formed in a plate shape, as shown in FIG. 4. In the illustrated embodiment, the projection 7 has a first surface 75 and a second surface 76 disposed downstream of the first surface 75 in the rotational direction RD of the impeller 2. Each of the first surface 75 and the second surface 76 extends along the axial direction X and the radial direction Y of the impeller 2. As illustrated, the at least one projection 7 may include a plurality of (two in the illustrated example) projections 7 which are spaced apart from each other in the circumferential direction.

With the above configuration, the compressor housing 3 includes at least one projection 7 protruding from the front-side inner peripheral surface 5 inward in the radial direction. As described above, at a low flow rate when the intake flow rate of the centrifugal compressor 1 is low, a reverse flow RF may occur in the vicinity of the shroud surface 4. The reverse flow RF has a strong centrifugal effect due to a swirl component directed in the rotational direction RD of the impeller 2 imparted by the rotation of the impeller 2. The reverse flow RF having such a strong centrifugal effect flows along the front-side inner peripheral surface 5 while swirling in the rotational direction RD and collides with (the first surface 75 of) the projection 7. By causing the reverse flow RF to collide with the projection 7, the reverse flow RF can be suppressed. The projection 7 disposed near the leading edge 25 of the impeller 2 in the axial direction X is more effective in suppressing the reverse flow RF. With the above configuration, since the rear end 71 of the projection 7 is connected to the front end 42 of the shroud surface 4, the projection 7 is located near the leading edge 25 in the axial direction X, effectively suppressing the reverse flow RF. By suppressing the reverse flow RF, it is possible to reduce the surging flow rate in a low flow rate operating region, so it is possible to improve the efficiency of the centrifugal compressor 1.

Additionally, with the above configuration, the projection 7 is formed in a plate shape, and in a cross-sectional view along the axis CA of the impeller 2, has the inclined front edge 73 extending obliquely to the axis CA of the impeller 2 from the front end 72 of the projection 7 toward the rear side XR. In this case, compared to the case where the front edge 73A of the projection 7 extends in the direction perpendicular to the axis CA of the impeller 2, the flow of the main flow MF led to the impeller 2 is less obstructed, so that collision loss of the main flow MF due to collision with the projection 7 can be suppressed. Thus, it is possible to effectively suppress pressure loss (particularly, pressure loss in a high flow rate operating region) of the main flow MF led to the impeller 2, so it is possible to improve the efficiency of the centrifugal compressor 1.

In some embodiments, as shown in FIG. 3, the projection 7 has an inner edge 74 extending from the rear end of the inclined front edge 73 toward the rear side XR and connected to the front end 42 of the shroud surface 4. The inner edge 74 is disposed outward of the tip 24A of the impeller 2 at the leading edge 25 in the radial direction Y. The projection 7 having such an inner edge 74 can suppress the collision of the main flow MF flowing on the inner side of the intake air introduction path 50 in the radial direction Y with the projection 7, thus effectively reducing pressure loss of the main flow MF led to the impeller 2.

Figure 5:
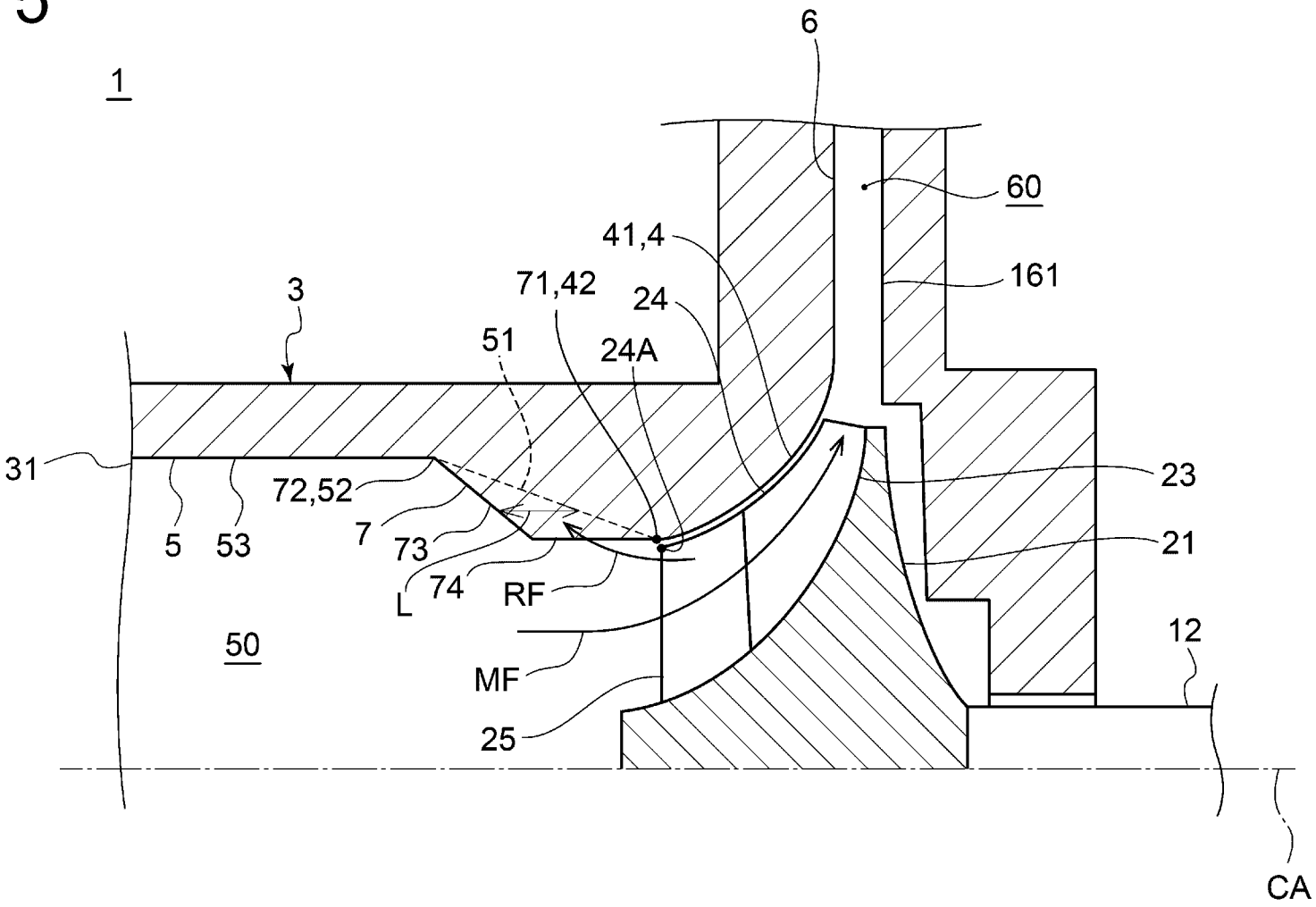
FIG. 5 is an explanatory view for describing a modification of the compressor housing according to the first embodiment.

FIG. 5 is an explanatory view for describing a modification of the compressor housing according to the first embodiment.

In some embodiments, as shown in FIGS. 3 and 5, the front-side inner peripheral surface 5 includes a tapered surface 51 increasing in diameter from the front end 42 of the shroud surface 4 toward the front side XF, and an axial surface 53 extending from a front end 52 of the tapered surface 51 along the axial direction X toward the front side XF. The projection 7 extends at least over the entire length of the tapered surface 51 in the axial direction X.

In the embodiment shown in FIG. 3, the projection 7 is disposed on both the tapered surface 51 and the axial surface 53. In the embodiment shown in FIG. 5, the projection 7 is disposed only on the tapered surface 51 of the front-side inner peripheral surface 5.

With the above configuration, since the front-side inner peripheral surface 5 of the compressor housing 3 includes the tapered surface 51 increasing in diameter from the front end 42 of the shroud surface 4 toward the front side XF, rapid construction loss of the main flow MF led to the impeller 2 can be suppressed. The reverse flow RF having a swirl component directed in the rotational direction RD of the impeller 2 flows along the tapered surface 51 toward the front side XF. When the projection 7 extends at least over the entire length of the tapered surface 51 in the axial direction X, the reverse flow RF flowing along the tapered surface 51 can be effectively suppressed.

In some embodiments, as shown in FIG. 5, the projection 7 is disposed only on the tapered surface 51 of the front-side inner peripheral surface 5. In this case, the reverse flow RF having a swirl component directed in the rotational direction RD of the impeller 2 flows along the tapered surface 51 toward the front side XF. When the projection 7 is disposed on the tapered surface 51, the reverse flow RF flowing along the tapered surface 51 can be effectively suppressed. In addition, when the projection 7 is disposed only on the tapered surface 51 of the front-side inner peripheral surface 5, that is, is not disposed on the axial surface 53 of the front-side inner peripheral surface 5, collision loss of the main flow MF due to collision with the projection 7 can be suppressed.

In some embodiments, in a cross-sectional view along the axis CA of the impeller 2 as shown in FIGS. 3 and 5, the length L of the projection 7 parallel to the axis changes in the radial direction. The reverse flow RF having a swirl component directed in the rotational direction RD of the impeller 2 flows along the tapered surface 51 toward the front side XF. In this case, when the projection 7 is disposed in an appropriate range to suppress the reverse flow RF flowing along the tapered surface 51, the reverse flow RF can be effectively suppressed while suppressing collision loss of the main flow MF due to collision with the projection 7.

In the embodiments shown in FIGS. 3 and 5, the length L increases outward in the radial direction. In this case, it is possible to effectively suppress collision loss of the main flow MF due to collision with the projection 7.

Figure 6:
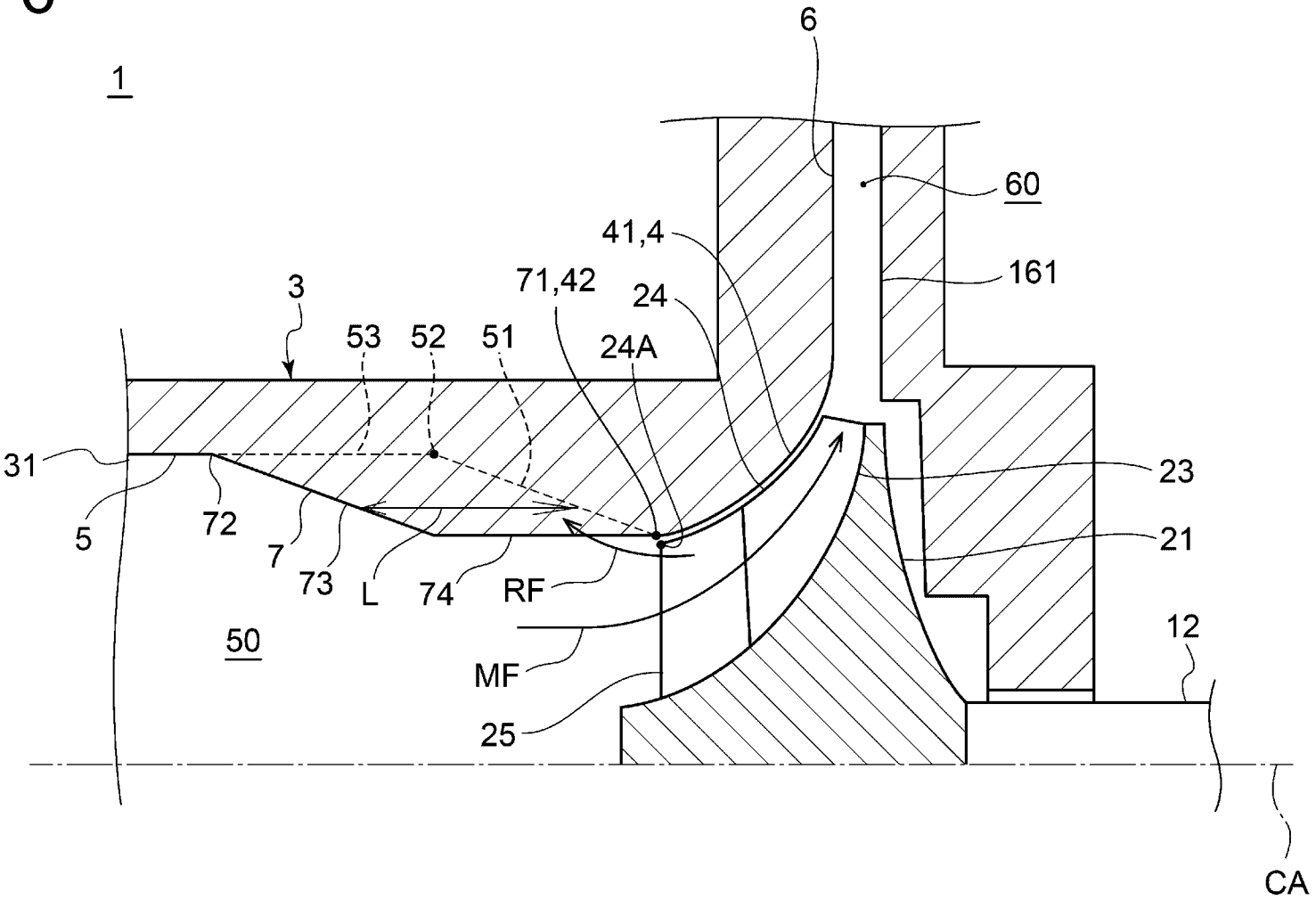
FIG. 6 is an explanatory view for describing a modification of the compressor housing according to the first embodiment.

FIG. 6 is an explanatory view for describing a modification of the compressor housing according to the first embodiment. The compressor housing 3 according to some embodiments may include the projection 7 with a constant length L in the radial direction. In other words, in some embodiments, in a cross-sectional view along the axis CA of the impeller 2 as shown in FIG. 6, the length L of the projection 7 parallel to the axis is constant in the radial direction.

Figure 7:
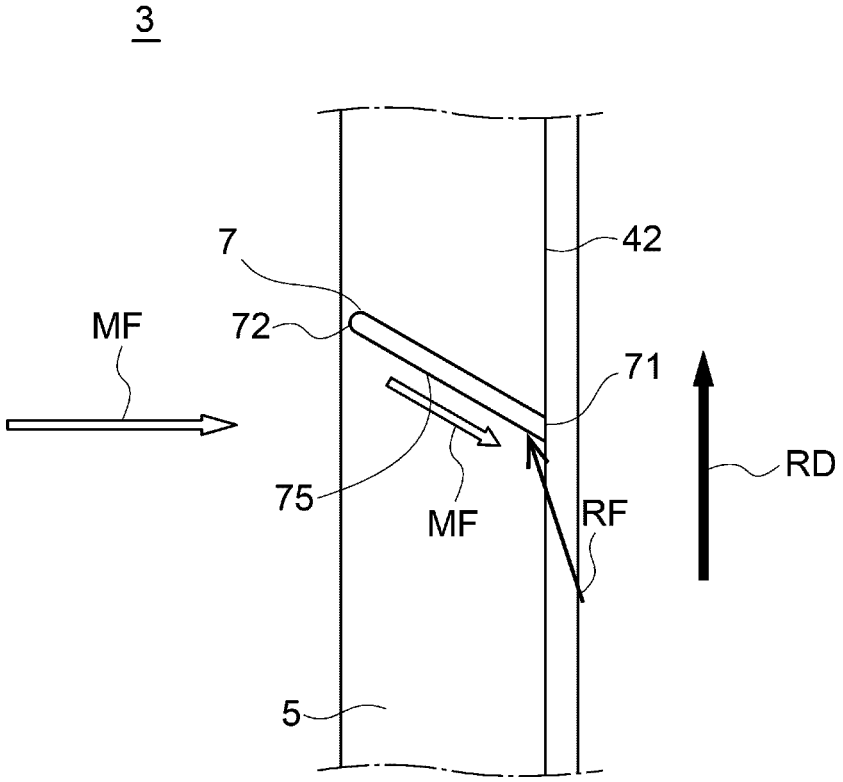
FIG. 7 is an explanatory view for describing a compressor housing according to the second embodiment.
Figure 8:
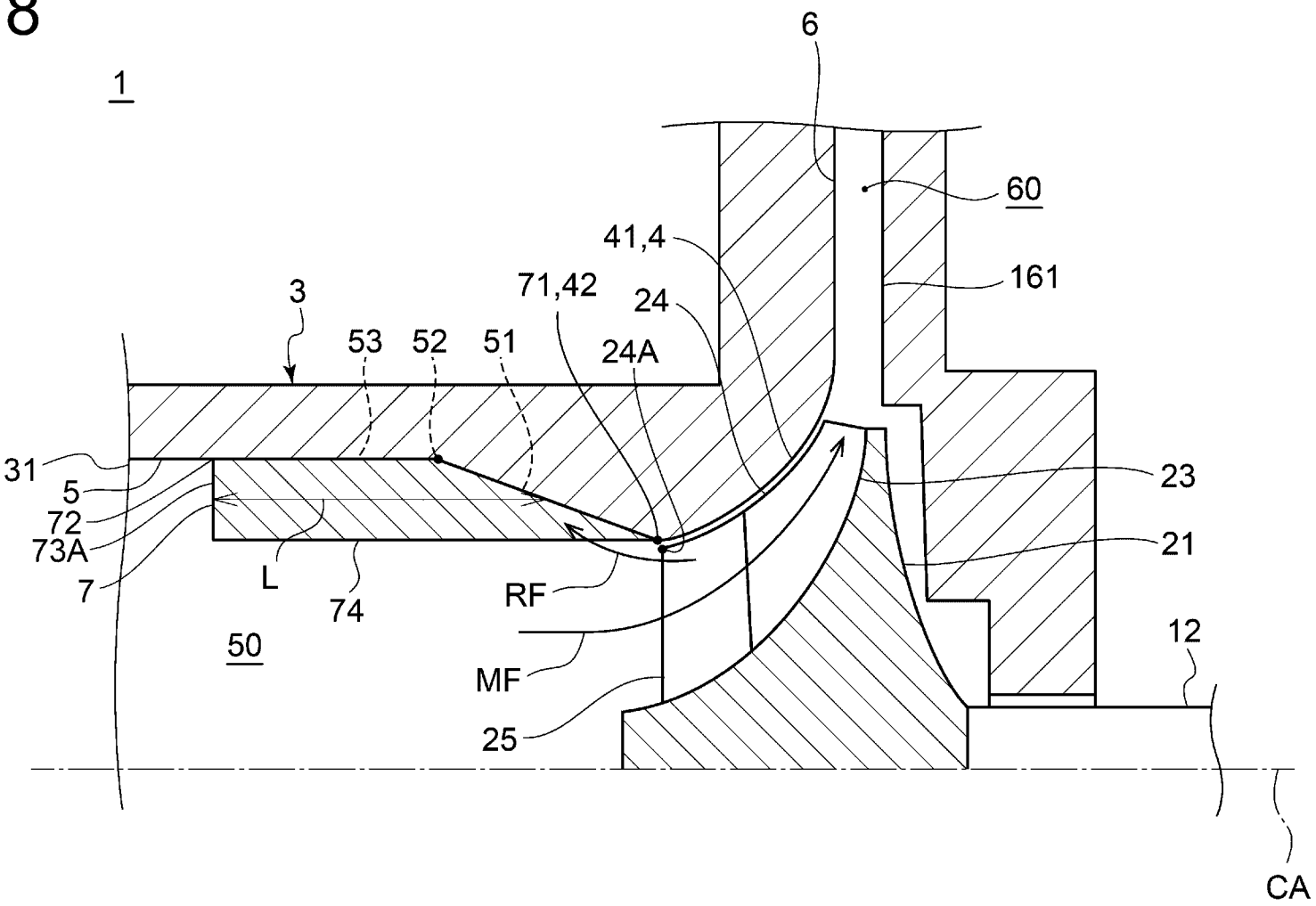
FIG. 8 is an explanatory view for describing a modification of the compressor housing according to the second embodiment.
Figure 9:
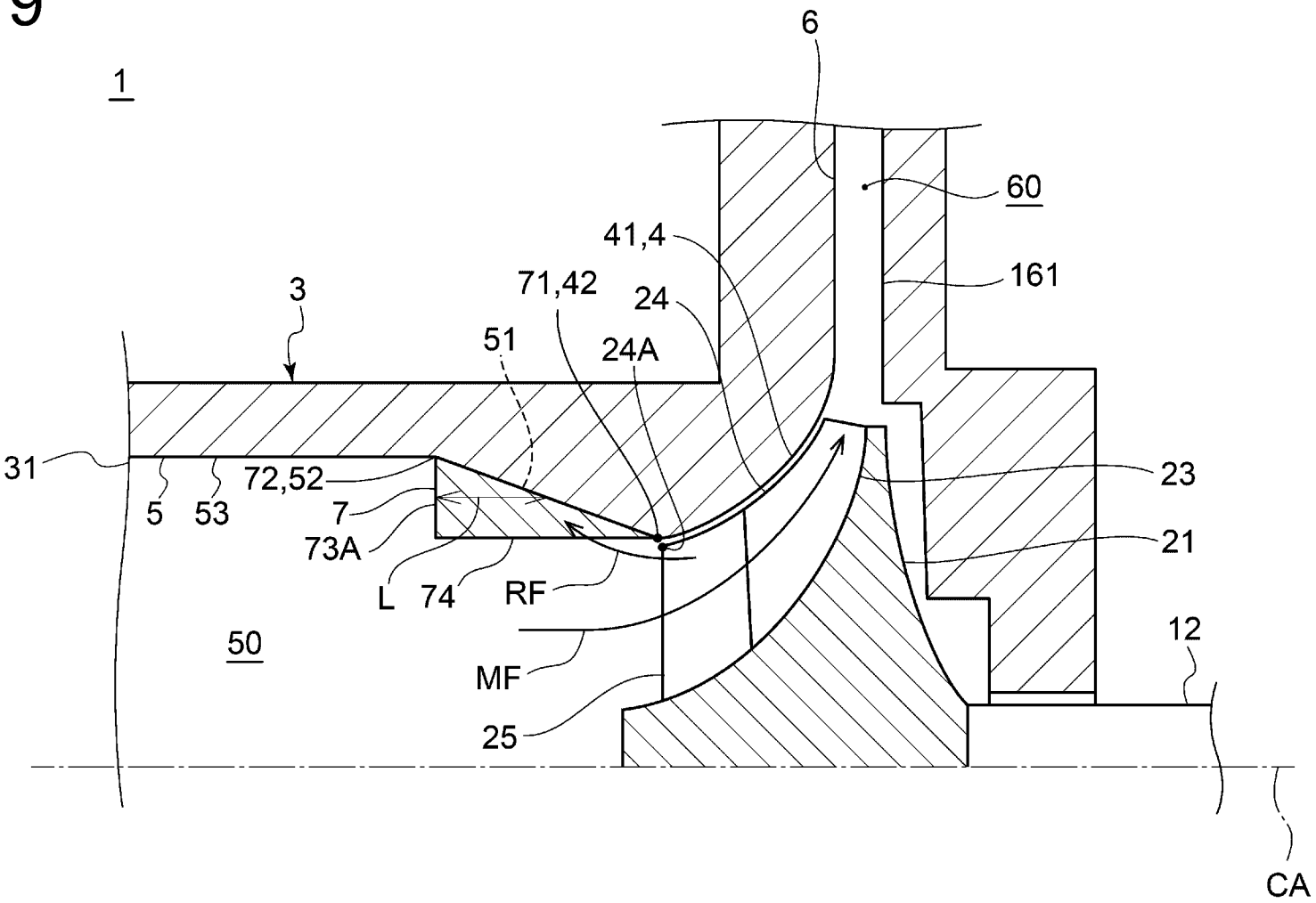
FIG. 9 is an explanatory view for describing a modification of the compressor housing according to the second embodiment.

FIG. 7 is an explanatory view for describing a compressor housing according to the second embodiment. FIGS. 8 and 9 are each an explanatory view for describing a modification of the compressor housing according to the second embodiment. FIG. 7 schematically shows the shroud surface 4 and the front-side inner peripheral surface 5 of the compressor housing 3, as viewed from the inner side in the radial direction of the impeller 2.

As shown in FIGS. 3, 5, 8, and 9, the compressor housing 3 according to some embodiments includes the shroud surface 4 including the surface 41 facing the tip 24 of the impeller blade 23 of the impeller 2 with a predetermined gap G, the front-side inner peripheral surface 5 formed on the front side XF of the shroud surface 4 in the axial direction and disposed outward of the front end 42 of the shroud surface 4 in the radial direction Y, and at least one projection 7 protruding from the front-side inner peripheral surface 5 inward in the radial direction Y. As shown in FIG. 7, the projection 7 is formed in a plate shape, and is configured such that the rear end 71 of the projection 7 is located upstream of the front end 72 of the projection 7 in the rotational direction RD of the impeller 2.

On the other hand, in some embodiments described above, the projection 7 is configured such that the rear end 71 of the projection 7 is in the same position as the front end 72 of the projection 7 in the rotational direction RD of the impeller 2.

In the illustrated embodiment, the rear end 71 of the projection 7 is connected to the front end 42 of the shroud surface 4. The projection 7 is formed linearly from the front end 72 to the rear end 71.

With the above configuration, since the rear end 71 of the projection 7 is located upstream of the front end 72 of the projection 7 in the rotational direction RD of the impeller 2, the projection 7 can impart a pre-swirl in the opposite direction to the rotational direction RD of the impeller 2 to the main flow MF led to the impeller 2 along the front-side inner peripheral surface 5. By imparting the pre-swirl to the main flow MF, the relative inflow velocity of the main flow MF when led to the impeller 2 can be increased. By increasing the relative inflow velocity of the main flow MF, it is possible to reduce the surging flow rate in a low flow rate operating region, so it is possible to improve the efficiency of the centrifugal compressor 1.

The present embodiment may be combined with some embodiments described above or may be implemented independently. For example, the present embodiment may be applied to the projection 7 having the inclined front edge 73, as shown in FIGS. 3 and 5, or to the projection 7 having the front edge 73A extending inward in the radial direction Y from the front end 72 of the projection 7, as shown in FIGS. 8 and 9.

In some embodiments, as shown in FIGS. 3 and 5, the projection 7 is formed integrally with the front-side inner peripheral surface 5 (e.g., tapered surface 51) by machining or casting.

With the above configuration, the projection 7 is formed integrally with the front-side inner peripheral surface 5 by machining or casting. In this case, compared to the case where the projection 7 formed separately from the front-side inner peripheral surface 5 is secured to the front-side inner peripheral surface 5 by welding or fastening with bolts or the like, the surface roughness of the front-side inner peripheral surface 5 can be improved. By improving the surface roughness of the front-side inner peripheral surface 5, pressure loss of the main flow MF led to the impeller 2 can be reduced.

In some embodiments, as shown in FIGS. 8 and 9, the projection 7 may be formed separately from the front-side inner peripheral surface 5.

In some embodiments described above, the projection 7 is disposed upstream of the impeller 2, but when such a projection 7 is disposed downstream of the impeller 2, the reverse flow downstream of the impeller 2 can be suppressed, and the efficiency of the centrifugal compressor 1 can be improved.

Figure 10:
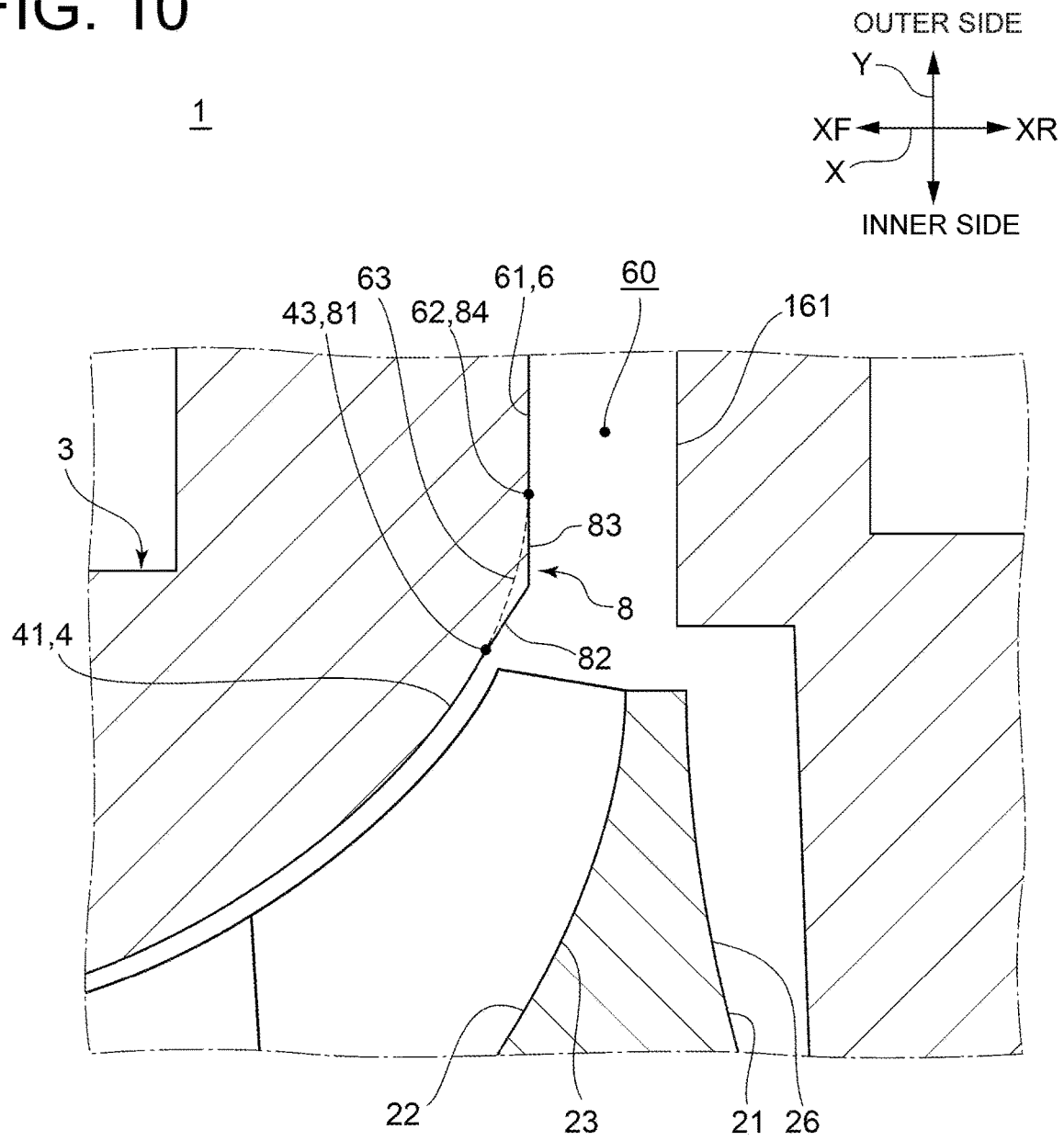
FIG. 10 is an explanatory view for describing a compressor housing according to the third embodiment.
Figure 11:
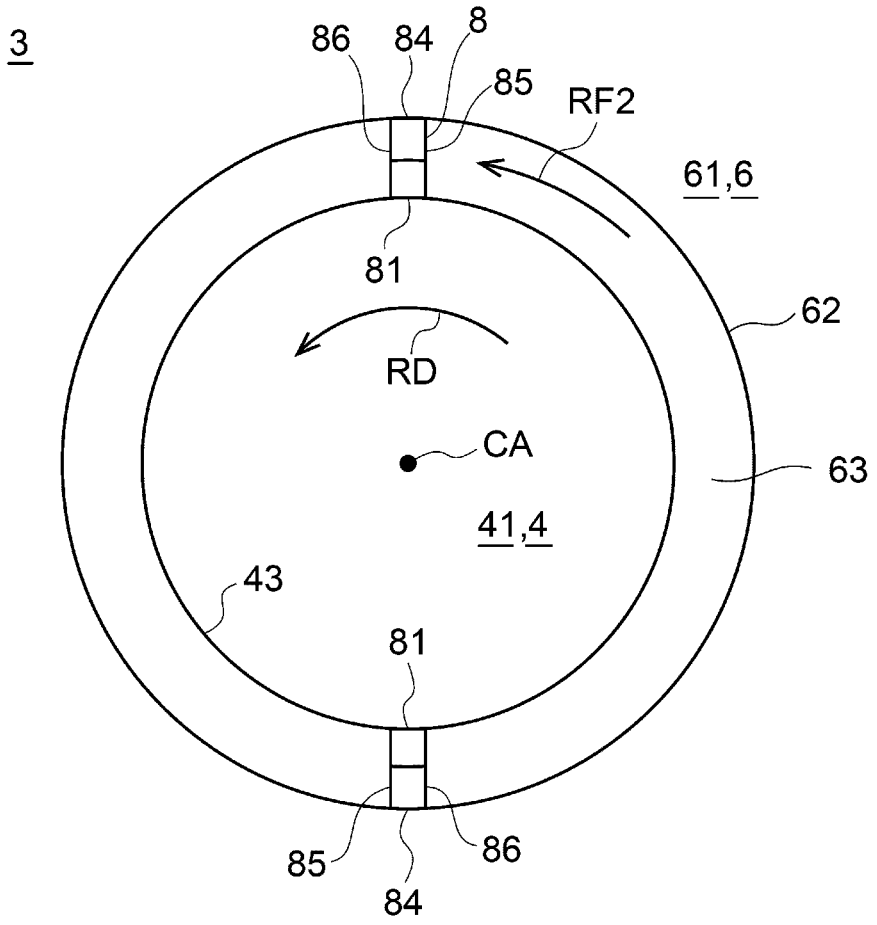
FIG. 11 is a schematic cross-sectional view schematically showing the vicinity of a pinch surface of the compressor housing shown in FIG. 10, as viewed from the rear side in the axial direction.

FIG. 10 is an explanatory view for describing a compressor housing according to the third embodiment. FIG. 11 is a schematic cross-sectional view schematically showing the vicinity of a pinch surface of the compressor housing shown in FIG. 10, as viewed from the rear side in the axial direction.

As shown in FIG. 10, the compressor housing 3 according to some embodiments includes the shroud surface 4 including the surface 41 facing the tip 24 of the impeller blade 23 of the impeller 2 with a predetermined gap G, a diffuser surface 6 disposed closer to a suction surface 26 (rear side XR) of the impeller 2 than a rear end 43 of the shroud surface 4 in the axial direction, the diffuser surface 6 including a radial surface 61 extending along the radial direction Y and a pinch surface 63 connecting an inner end 62 of the radial surface 61 to the rear end 43 of the shroud surface 4, and at least one diffuser-side projection 8 protruding from the pinch surface 63 toward the suction surface 26 (rear side XR) of the impeller 2 in the axial direction.

The diffuser-side projection 8 is disposed closer to a boss surface 22A (front side XF) of the impeller 2 than the radial surface 61 in the axial direction. An inner end 81 of the diffuser-side projection 8 is connected to the rear end 43 of the shroud surface 4.

In the illustrated embodiment, in a cross-sectional view along the axis CA of the impeller 2, as shown in FIG. 10, the diffuser-side projection 8 has a diffuser-side inclined front edge 82 extending obliquely to the axis CA of the impeller 2 from an inner end 81 of the diffuser-side projection 8 toward the rear side XR, and a rear edge 83 extending outward in the radial direction Y from the outer end of the diffuser-side inclined front edge 82 and connected at an outer end 84 to the inner end 62 of the radial surface 61.

The diffuser-side projection 8 is formed in a plate shape, as shown in FIG. 11. In the illustrated embodiment, the diffuser-side projection 8 has a first surface 85 and a second surface 86 disposed downstream of the first surface 85 in the rotational direction RD of the impeller 2. Each of the first surface 85 and the second surface 86 extends along the axial direction X and the radial direction Y of the impeller 2. As illustrated, the at least one diffuser-side projection 8 may include a plurality of (two in the illustrated example) diffuser-side projections 8 which are spaced apart from each other in the circumferential direction.

With the above configuration, the compressor housing 3 includes at least one diffuser-side projection 8 protruding from the pinch surface 63 toward the suction surface 26 (rear side XR) of the impeller 2 in the axial direction. The diffuser-side projection 8 can suppress a reverse flow RF2 having a swirl component directed in the rotational direction RD of the impeller 2 caused in the vicinity of the pinch surface 63. Thus, it is possible to suppress the swirl pressure loss of the main flow MF downstream of the impeller 2. By suppressing the reverse flow RF2, it is possible to suppress the rotating stall at the inlet of the diffuser passage 60 in a low flow rate operating region, so it is possible to improve the efficiency of the centrifugal compressor 1.

An uneven flow velocity distribution occurs downstream of the impeller 2 in the centrifugal compressor 1. The diffuser-side projection 8 acts as a vortex generator and suppresses boundary layer separation. This improves the efficiency of the centrifugal compressor 1 not only during the occurrence of rotating stall at the inlet of the diffuser passage 60, but also at the normal operating point of the centrifugal compressor 1.

The present embodiment may be combined with some embodiments described above or may be implemented independently. For example, the compressor housing 3 may include the projection 7 and the diffuser-side projection 8. In this case, it is possible to suppress the rotating stall upstream and downstream of the impeller 2, so it is possible to improve the efficiency of the centrifugal compressor 1 by the synergistic effect of the projection 7 and the diffuser-side projection 8.

In some embodiments, as shown in FIG. 10, the diffuser-side projection 8 is formed integrally with the diffuser surface 6 (e.g., pinch surface 63) by machining or casting.

With the above configuration, the diffuser-side projection 8 is formed integrally with the diffuser surface 6 by machining or casting. In this case, compared to the case where the diffuser-side projection 8 formed separately from the diffuser surface 6 is secured to the diffuser surface 6 by welding or fastening with bolts or the like, the surface roughness of the diffuser surface 6 can be improved. By improving the surface roughness of the diffuser surface 6, pressure loss of the main flow MF having passed through the impeller 2 can be reduced.

In some embodiments, the diffuser-side projection 8 may be formed separately from the diffuser surface 6.

As shown in FIGS. 1 and 2, the centrifugal compressor 1 according to some embodiments includes the above-described compressor housing 3. In this case, it is possible to effectively suppress pressure loss of the working fluid in the compressor housing 3, so it is possible to improve the efficiency of the centrifugal compressor 1.

The present disclosure is not limited to the embodiments described above, but includes modifications to the embodiments described above, and embodiments composed of combinations of those embodiments.

The contents described in the above embodiments would be understood as follows, for instance.

1) A compressor housing (3) according to at least one embodiment of the present disclosure is a compressor housing for rotatably accommodating an impeller (2) of a centrifugal compressor (1), including: a shroud surface (4) including a surface (41) facing a tip (24) of an impeller blade (23) of the impeller with a predetermined gap (G); a front-side inner peripheral surface (5) formed on a front side of the shroud surface (4) in an axial direction and disposed outward of a front end (42) of the shroud surface (4) in a radial direction; and at least one projection (7) protruding from the front-side inner peripheral surface (5) inward in the radial direction. A rear end (71) of the at least one projection (7) is configured to be connected to the front end (42) of the shroud surface (4). The at least one projection (7) is formed in a plate shape, and in a cross-sectional view along an axis (CA) of the impeller (2), has an inclined front edge (73) extending obliquely to the axis of the impeller from a front end (72) of the projection (7) toward a rear side.

With the above configuration 1), the compressor housing includes at least one projection protruding from the front-side inner peripheral surface inward in the radial direction. By causing a reverse flow to collide with the projection, the reverse flow can be suppressed. The projection disposed near the leading edge of the impeller is more effective in suppressing the reverse flow. With the above configuration 1), since the rear end of the projection is connected to the front end of the shroud surface, the projection is located near the leading edge in the axial direction, effectively suppressing the reverse flow. By suppressing the reverse flow, it is possible to reduce the surging flow rate in a low flow rate operating region, so it is possible to improve the efficiency of the centrifugal compressor.

Additionally, with the above configuration 1), the projection is formed in a plate shape, and in a cross-sectional view along the axis of the impeller, has the inclined front edge extending obliquely to the axis of the impeller from the front end of the projection toward the rear side. In this case, compared to the case where the front edge of the projection extends in the direction perpendicular to the axis of the impeller, the flow of the main flow led to the impeller is less obstructed, so that collision loss of the main flow due to collision with the projection can be suppressed. Thus, it is possible to effectively suppress pressure loss (particularly, pressure loss in a high flow rate operating region) of the main flow led to the impeller, so it is possible to improve the efficiency of the centrifugal compressor.

2) In some embodiments, in the compressor housing (3) as defined in the above configuration 1), the front-side inner peripheral surface (5) includes a tapered surface (51) increasing in diameter from the front end (42) of the shroud surface (4) toward the front side, and an axial surface (53) extending frontward from a front end (52) of the tapered surface (51) along the axial direction. The at least one projection (7) extends at least over the entire axial length of the tapered surface (51).

With the above configuration 2), since the front-side inner peripheral surface of the compressor housing includes the tapered surface increasing in diameter from the front end of the shroud surface toward the front side, rapid construction loss of the main flow led to the impeller can be suppressed. The reverse flow having a swirl component directed in the rotational direction of the impeller flows along the tapered surface toward the front side. Since the projection extends at least over the entire length of the tapered surface in the axial direction, the reverse flow flowing along the tapered surface can be effectively suppressed.

3) In some embodiments, in the compressor housing (3) as defined in the above configuration 2), in a cross-sectional view along the axis of the impeller, a length (L) of the at least one projection (7) parallel to the axis changes in the radial direction.

With the above configuration 3), in a cross-sectional view along the axis of the impeller, the length of the projection parallel to the axis changes in the radial direction. The reverse flow flows along the tapered surface toward the front side. In this case, since the projection can be provided in an appropriate range to suppress the reverse flow flowing along the tapered surface, the reverse flow can be effectively suppressed while suppressing collision loss of the main flow due to collision with the projection.

4) In some embodiments, in the compressor housing (3) as defined in any one of the above configurations 1) to 3), the at least one projection (7) is configured such that the rear end (71) of the projection (7) is located upstream of the front end (72) of the projection (7) in a rotational direction (RD) of the impeller.

With the above configuration 4), since the rear end of the projection is located upstream of the front end of the projection in the rotational direction of the impeller, the projection can impart a pre-swirl in the opposite direction to the rotational direction of the impeller to the main flow led to the impeller along the front-side inner peripheral surface. By imparting the pre-swirl to the main flow, the relative inflow velocity of the main flow when led to the impeller can be increased. By increasing the relative inflow velocity of the main flow, it is possible to reduce the surging flow rate in a low flow rate operating region, so it is possible to improve the efficiency of the centrifugal compressor.

5) In some embodiments, in the compressor housing (3) as defined in any one of the above configurations 1) to 4), the at least one projection (7) is formed integrally with the front-side inner peripheral surface (5) by machining or casting.

With the above configuration 5), the projection is formed integrally with the front-side inner peripheral surface by machining or casting. In this case, compared to the case where the projection formed separately from the front-side inner peripheral surface is secured to the front-side inner peripheral surface by welding or fastening with bolts or the like, the surface roughness of the front-side inner peripheral surface can be improved. By improving the surface roughness of the front-side inner peripheral surface, pressure loss of the main flow led to the impeller can be reduced.

6) In some embodiments, in the compressor housing (3) as defined in any one of the above configurations 1) to 5), the front-side inner peripheral surface (5) includes a tapered surface (51) increasing in diameter from the front end of the shroud surface toward the front side, and an axial surface (52) extending frontward from a front end of the tapered surface along the axial direction. The at least one projection (7) is disposed only on the tapered surface (51) of the front-side inner peripheral surface (5).

With the above configuration 6), the reverse flow flows along the tapered surface toward the front side. When the projection is disposed on the tapered surface, the reverse flow flowing along the tapered surface can be effectively suppressed. In addition, when the projection is disposed only on the tapered surface of the front-side inner peripheral surface, that is, is not disposed on the axial surface of the front-side inner peripheral surface, collision loss of the main flow due to collision with the projection can be suppressed.

7) In some embodiments, the compressor housing (3) as defined in any one of the above configurations 1) to 6) further includes: a diffuser surface (6) disposed closer to a suction surface (26) of the impeller (2) than a rear end (43) of the shroud surface (4) in the axial direction, the diffuser surface (6) including a radial surface (61) extending along the radial direction and a pinch surface (63) connecting an inner end (62) of the radial surface (61) to the rear end (43) of the shroud surface (4), and at least one diffuser-side projection (8) protruding from the pinch surface (63) toward the suction surface (26) of the impeller (2) in the axial direction. The at least one diffuser-side projection (8) is disposed closer to a boss surface (22A) of the impeller (2) than the radial surface (61) in the axial direction. An inner end (81) of the at least one diffuser-side projection (8) is connected to the rear end (43) of the shroud surface (4).

With the above configuration 7), the compressor housing includes at least one diffuser-side projection protruding from the pinch surface toward the suction surface (rear side) of the impeller in the axial direction. The diffuser-side projection can suppress a reverse flow having a swirl component directed in the rotational direction of the impeller caused in the vicinity of the pinch surface. Thus, it is possible to suppress the swirl pressure loss of the main flow downstream of the impeller. By suppressing the reverse flow, it is possible to suppress the rotating stall at the inlet of the diffuser passage in a low flow rate operating region, so it is possible to improve the efficiency of the centrifugal compressor.

An uneven flow velocity distribution occurs downstream of the impeller in the centrifugal compressor. The diffuser-side projection acts as a vortex generator and suppresses boundary layer separation. This improves the efficiency of the centrifugal compressor not only during the occurrence of rotating stall at the inlet of the diffuser passage, but also at the normal operating point of the centrifugal compressor.

8) A compressor housing (3) according to at least one embodiment of the present disclosure is a compressor housing for rotatably accommodating an impeller (2) of a centrifugal compressor (1), including: a shroud surface (4) including a surface (41) facing a tip (24) of an impeller blade (23) of the impeller with a predetermined gap (G); a diffuser surface (6) disposed closer to a suction surface (26) of the impeller (2) than a rear end (43) of the shroud surface (4) in the axial direction, the diffuser surface (6) including a radial surface (61) extending along the radial direction and a pinch surface (63) connecting an inner end (62) of the radial surface (61) to the rear end (43) of the shroud surface (4), and at least one diffuser-side projection (8) protruding from the pinch surface (63) toward the suction surface (26) of the impeller (2) in the axial direction. The at least one diffuser-side projection (8) is disposed closer to a boss surface (22A) of the impeller (2) than the radial surface (61) in the axial direction. An inner end (81) of the at least one diffuser-side projection (8) is connected to the rear end (43) of the shroud surface (4).

With the above configuration 8), the compressor housing includes at least one diffuser-side projection protruding from the pinch surface toward the suction surface (rear side) of the impeller in the axial direction. The diffuser-side projection can suppress a reverse flow having a swirl component directed in the rotational direction of the impeller caused in the vicinity of the pinch surface. Thus, it is possible to suppress the swirl pressure loss of the main flow downstream of the impeller. By suppressing the reverse flow, it is possible to suppress the rotating stall at the inlet of the diffuser passage in a low flow rate operating region, so it is possible to improve the efficiency of the centrifugal compressor.

An uneven flow velocity distribution occurs downstream of the impeller in the centrifugal compressor. The diffuser-side projection acts as a vortex generator and suppresses boundary layer separation. This improves the efficiency of the centrifugal compressor not only during the occurrence of rotating stall at the inlet of the diffuser passage, but also at the normal operating point of the centrifugal compressor.

9) In some embodiments, in the compressor housing (3) as defined in the above configuration 7) or 8), the diffuser-side projection (8) is formed integrally with the diffuser surface (6) by machining or casting.

With the above configuration 9), the diffuser-side projection is formed integrally with the diffuser surface by machining or casting. In this case, compared to the case where the diffuser-side projection formed separately from the diffuser surface is secured to the diffuser surface by welding or fastening with bolts or the like, the surface roughness of the diffuser surface can be improved. By improving the surface roughness of the diffuser surface, pressure loss of the main flow having passed through the impeller can be reduced.

10) A centrifugal compressor (1) according to at least one embodiment of the present disclosure includes the compressor housing (3) described in any one of the above configurations 1) to 9).

With the above configuration 10), it is possible to effectively suppress pressure loss of the working fluid in the compressor housing, so it is possible to improve the efficiency of the centrifugal compressor.

REFERENCE SIGNS LIST

1 Centrifugal compressor
2 Impeller
21 Hub
22 Outer surface
22A Boss surface
23 Impeller blade
24, 24A Tip
25 Leading edge
26 Suction surface
3 Compressor housing
31 Intake port
32 Discharge port
33 Shroud portion
34 Intake air introduction portion
35 Diffuser portion
36 Scroll portion
360 Scroll passage
361 Passage wall surface
4 Shroud surface
41 Surface
42 Front end
43 Rear end
5 Front-side inner peripheral surface
50 Intake air introduction path
51 Tapered surface
52 Front end
53 Axial surface
6 Diffuser surface
60 Diffuser passage
61 Radial surface
62 Inner end
63 Pinch surface
7 Projection
71 Rear end
72 Front end
73, 73A Front edge
74 Inner edge
75 First surface
76 Second surface
8 Diffuser-side projection
81 Inner end
82 Front edge
83 Rear edge
84 Outer end
85 First surface
86 Second surface
10 Turbocharger
11 Turbine
12 Rotational shaft
13 Turbine rotor
14 Turbine housing
141 Turbine-side introduction port
142 Turbine-side discharge port
15 Bearing
16 Bearing housing
161 Surface
CA Axis
G Gap
MF Main flow
RD Rotational direction
RF, RF2 Reverse flow
X Axial direction XF Front side (in axial direction)
XR Rear side (in axial direction)
Y Radial direction

The invention claimed is:

1. A compressor housing for rotatably accommodating an impeller of a centrifugal compressor, comprising:

a shroud surface including a surface facing a tip of an impeller blade of the impeller with a predetermined gap;

a front-side inner peripheral surface formed on a front side of the shroud surface in an axial direction and disposed outward of a front end of the shroud surface in a radial direction; and at least one projection protruding from the front-side inner peripheral surface inward in the radial direction, wherein a rear end of the at least one projection is configured to be connected to the front end of the shroud surface, wherein the at least one projection is formed in a plate shape, and in a cross-sectional view along an axis of the impeller, has an inclined front edge extending obliquely to the axis of the impeller from a front end of the at least one projection toward a rear side and an inner edge extending from a rear end of the inclined front edge toward the rear side and connected to the front end of the shroud surface, and wherein the inner edge extends into the shroud surface facing the tip of the impeller blade.

2. The compressor housing according to claim 1, wherein the at least one projection is configured such that the rear end of the at least one projection is located upstream of the front end of the at least one projection in a rotational direction of the impeller.

3. The compressor housing according to claim 1, wherein the at least one projection is formed integrally with the front-side inner peripheral surface by machining or casting.

4. A centrifugal compressor, comprising the compressor housing according to claim 1.

5. A compressor housing for rotatably accommodating an impeller of a centrifugal compressor, comprising:

a shroud surface including a surface facing a tip of an impeller blade of the impeller with a predetermined gap;

a front-side inner peripheral surface formed on a front side of the shroud surface in an axial direction and disposed outward of a front end of the shroud surface in a radial direction; and at least one projection protruding from the front-side inner peripheral surface inward in the radial direction, wherein a rear end of the at least one projection is configured to be connected to the front end of the shroud surface, wherein the at least one projection is formed in a plate shape, and in a cross-sectional view along an axis of the impeller, has an inclined front edge extending obliquely to the axis of the impeller from a front end of the at least one projection toward a rear side, wherein the front-side inner peripheral surface includes a tapered surface increasing in diameter from the front end of the shroud surface toward the front side, and an axial surface extending frontward from a front end of the tapered surface along the axial direction, and wherein the at least one projection extends at least over the entire axial length of the tapered surface.

6. The compressor housing according to claim 5, wherein, in the cross-sectional view along the axis of the impeller, a length of the at least one projection parallel to the axis changes in the radial direction.

7. A compressor housing for rotatably accommodating an impeller of a centrifugal compressor, comprising:

a shroud surface including a surface facing a tip of an impeller blade of the impeller with a predetermined gap;

a front-side inner peripheral surface formed on a front side of the shroud surface in an axial direction and disposed outward of a front end of the shroud surface in a radial direction; and at least one projection protruding from the front-side inner peripheral surface inward in the radial direction, wherein a rear end of the at least one projection is configured to be connected to the front end of the shroud surface, wherein the at least one projection is formed in a plate shape, and in a cross-sectional view along an axis of the impeller, has an inclined front edge extending obliquely to the axis of the impeller from a front end of the at least one projection toward a rear side, wherein the front-side inner peripheral surface includes a tapered surface increasing in diameter from the front end of the shroud surface toward the front side, and an axial surface extending frontward from a front end of the tapered surface along the axial direction, and wherein the at least one projection is disposed only on the tapered surface of the front-side inner peripheral surface.

8. A compressor housing for rotatably accommodating an impeller of a centrifugal compressor, comprising:

a shroud surface including a surface facing a tip of an impeller blade of the impeller with a predetermined gap;

a front-side inner peripheral surface formed on a front side of the shroud surface in an axial direction and disposed outward of a front end of the shroud surface in a radial direction; and at least one projection protruding from the front-side inner peripheral surface inward in the radial direction, wherein a rear end of the at least one projection is configured to be connected to the front end of the shroud surface, wherein the at least one projection is formed in a plate shape, and in a cross-sectional view along an axis of the impeller, has an inclined front edge extending obliquely to the axis of the impeller from a front end of the at least one projection toward a rear side, wherein the compressor housing further comprises:

a diffuser surface disposed closer to a suction surface of the impeller than a rear end of the shroud surface in the axial direction, the diffuser surface including a radial surface extending along the radial direction and a pinch surface connecting an inner end of the radial surface to the rear end of the shroud surface; and at least one diffuser-side projection protruding from the pinch surface toward the suction surface of the impeller in the axial direction, wherein the at least one diffuser-side projection is disposed closer to a boss surface of the impeller than the radial surface in the axial direction, and wherein an inner end of the at least one diffuser-side projection is connected to the rear end of the shroud surface.

9. The compressor housing according to claim 8, wherein the at least one diffuser-side projection is formed integrally with the diffuser surface by machining or casting.

* * * * *